US006616237B2

(12) United States Patent
Sonner et al.

(10) Patent No.: US 6,616,237 B2
(45) Date of Patent: Sep. 9, 2003

(54) CONNECTOR FOR SUPPORT FRAME

(75) Inventors: Robert J. Sonner, South Wales, NY (US); Brian S. Kelly, Orchard Park, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/742,327

(22) Filed: Dec. 22, 2000

(65) Prior Publication Data

US 2003/0034685 A1 Feb. 20, 2003

(51) Int. Cl.[7] ..... A47C 7/00

(52) U.S. Cl. ..... 297/440.22; 297/452.13; 297/DIG. 11

(58) Field of Search ..... 297/440.24, 440.22, 297/440.2, DIG. 11, 217.3, 217.4, 274, 277, 440.15, 260.1, 272.4, 376, 452.2, 373, 327, 452.13; 403/282, 326

(56) References Cited

U.S. PATENT DOCUMENTS

| | | | | |
|---|---|---|---|---|
| 2,073,155 A | | 3/1937 | Ivey | 248/150 |
| 2,848,040 A | | 8/1958 | Chernivsky | 155/189 |
| 2,981,315 A | | 4/1961 | Schaffer | 155/54 |
| 3,529,857 A | | 9/1970 | Dalton et al. | 287/20.5 |
| 4,266,807 A | * | 5/1981 | Griffin | 280/650 |
| 4,270,799 A | | 6/1981 | Flaum | 297/440 |
| 4,553,786 A | * | 11/1985 | Lockett et al. | 297/440.1 |
| 4,674,795 A | * | 6/1987 | Nelson | 297/239 |
| 4,692,050 A | | 9/1987 | Kaufman | 403/3 |
| 4,903,980 A | | 2/1990 | Schwartz | 280/647 |
| 5,187,826 A | | 2/1993 | Mariol | 5/655 |
| 5,360,258 A | | 11/1994 | Alivizatos | 297/440.11 |
| 5,411,315 A | * | 5/1995 | Greenwood | 297/440.24 |
| 5,460,430 A | * | 10/1995 | Miga et al. | 297/452.13 |
| 5,503,458 A | | 4/1996 | Petrie | 297/452.13 |
| 5,507,564 A | * | 4/1996 | Huang | 297/452.13 |
| 5,509,721 A | * | 4/1996 | Huang | 297/452.13 |
| 5,779,386 A | | 7/1998 | Eichhorn | |
| 5,911,431 A | | 6/1999 | Brown et al. | 280/642 |

FOREIGN PATENT DOCUMENTS

| | | |
|---|---|---|
| CA | 867134 | 3/1971 |
| CH | 278876 | 2/1952 |
| DE | 3244398 A1 | 12/1982 |
| FR | 2 428 996 | 1/1980 |
| GB | 2 256 023 A | 11/1992 |

* cited by examiner

*Primary Examiner*—Peter M. Cuomo
*Assistant Examiner*—Erika Garrett
(74) *Attorney, Agent, or Firm*—Morgan, Lewis & Bockius LLP

(57) ABSTRACT

A connector for securing two portions of a frame is disclosed. The connector is well suited for providing a low cost and reliable connection between first and second portions of a body support structure. In the preferred embodiment, the connector is used to secure the ground-engaging leg portions of a child's bouncer seat.

25 Claims, 13 Drawing Sheets

CONNECTOR FOR SUPPORT FRAME

The invention relates broadly to a connector for connecting portions of a body support structure and more particularly, the invention relates to a reliable, low cost and wear resistant connector for a support frame of a body support such as a seat. The connector of the invention is particularly well suited for connecting portions of a support frame associated with a child's seat.

BACKGROUND OF THE INVENTION

There are a variety of frame joints, or connectors for body supports (e.g., chairs, beds, recliners) that are known in the art. The type of joint or connector suitable for connecting a particular type of body support can vary depending on, for example, the particular loading environment, the need to reduce manufacturing costs, and/or the need for providing a durable connector for use with a support structure which is frequently assembled and disassembled, subject to abuse and/or frequently transported by the user. Unfortunately, the known connectors do not offer an adequate solution for addressing all of the foregoing needs.

Often times, a frame connector offers a low cost and suitable connection for the intended loading environment, but will suffer from other drawbacks, such as a lack of wear resistance and/or being particularly prone to failure through repeated use of the body support over a relatively short period of time. For example, U.S. Pat. No. 4,553,786 to Lockett, which discloses a tubular cross member 31 which is tightly fit with sides members 30 at a bend 35, relies on a friction-fit type of connection. While the Lockett-type of connection is sometimes suitable for providing a stable frame for supporting a child placed in the seat, over time the connection is susceptible to premature wear, resulting in a reduced effectiveness. This is especially evident in seats which are frequently transported and/or where frame portions are frequently attached and detached.

In view of these and other drawbacks and/or disadvantages in the known body support frame connectors, there exists a need for providing a connector for a body supporting frame that is durable, wear resistant and offers a cost effective connecting structure that can reliably maintain the support frame during use.

SUMMARY OF THE INVENTION

The needs identified above are met, and the shortcomings of prior art body support frame connector designs are overcome by the frame connector of the present invention. In one aspect there is provided a child support device including first and second frames, each of which includes a ground-engaging portion, child-supporting portion and an elongate leg having an end, the leg defining a longitudinally extending leg axis, a connecting portion extending parallel to the first leg axis and terminating at the first leg end, the connecting portion including an outwardly extending protrusion extending approximately perpendicular to the first leg axis, and a retaining portion including a slot extending parallel to the second leg axis for receiving the connecting portion and a locking surface for engaging the protrusion, wherein the first and second legs are coupled together by insertion of the connecting portion into the retaining portion.

In a second aspect of the invention there is provided a child's seat which includes first and second ground engaging leg portions extending forwardly and diverging outwardly from first and second rear ends and terminating at first and second forward ends thereof, a seat for receiving a child thereon, the seat being connected to each of the first and second forward ends wherein when a child is placed in the seat, the weight of the child tends to cause the first and second legs to displace outwardly, and a coupler for releasably retaining said first and second leg portions in a fixed, spiced relation. The coupler includes a first portion extending approximately perpendicular to the first leg, an oversized slot extending approximately perpendicular to the second leg and being adapted for receiving the first portion and the slot defining a clearance that is slightly greater than the cross-sectional dimensions of the first portion so as to allow the first portion to move freely within the slot, and a locking means for retaining the first portion within said slot when a child is placed in the seat, the locking means including a protrusion formed on one of the first portion and the slot for engagement with a locking surface formed on the other of the first portion and the slot.

In another aspect of the invention there is disclosed a method for providing a connectable support frame for a child support, the connectable support frame being formed from a single type of material. This method includes the steps of forming a left elongate frame portion with a terminal end and outwardly projecting knob integrally formed therewith, wherein the knob is formed so as to project upwardly from the terminal end, and forming a right elongate frame portion with a terminal end describing a longitudinally extending slot and locking surface integrally formed therewith, the slot including an opening describing a height sufficient for receiving the left terminal end and knob within the slot, and wherein the left frame portion is connectable to the right frame portion by aligning the left terminal end with the slot and inserting the left terminal end and knob into the slot.

In another aspect of the invention, there is provided a connector that is highly wear resistant. In this aspect of the invention, there is provided a connector that does not rely on a snug fit between mating frame portions as this type of coupling can become ineffective as a frame connector over a relatively short period of time.

In another aspect of the invention, there is provided a connector that is easy to manufacture.

In another aspect of the invention, there is provided a connector which may be integrally formed with the structure that is to be connected.

In another aspect of the invention, there is provided a connector that is configured so as to exploit the loading of the supporting structure connected by the connector. In this aspect of the invention, the structure providing the locking portion of the connector may be positioned such that when the seat is in use or when the seat is being assembled, the loading of the support frame urges the structure associated with the locking portions into a locking relationship.

Additional features and advantages of the invention will be set forth or be apparent from the description that follows. The features and advantages of the invention will be realized and attained by the structures and methods particularly pointed out in the written description and claims hereof as well as the appended drawings.

It is to be understood that both the foregoing general description and the following detailed description are exemplary and explanatory and are intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate preferred embodiments of the invention and together with the description serve to explain the principles of the invention. In the drawings.

DETAILED DESCRIPTION OF THE PREFERRED EMBODIMENTS

Figure 1:
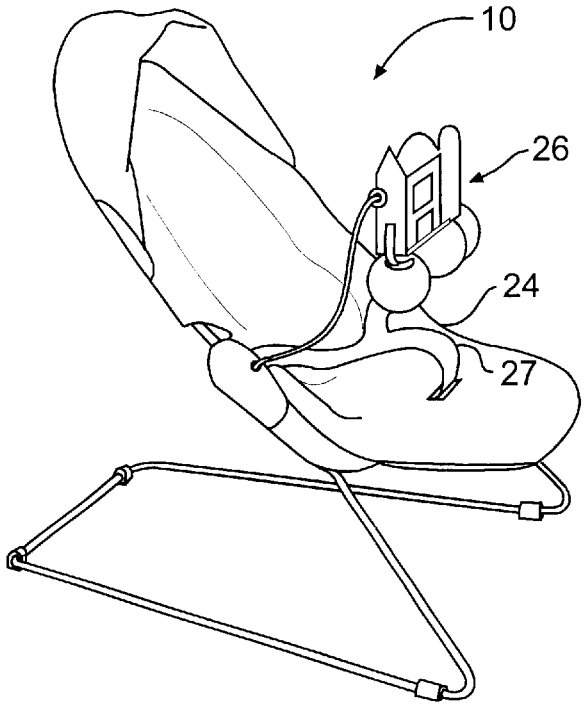
FIG. 1 is a perspective view of a first embodiment of a child support made in accordance with the principles of invention

The frame connector of the invention is preferably implemented as a frame connector for a child's seat and more specifically, a child's bouncer seat. FIGS. 1–9 refer to a fist embodiment of a child's bouncer seat 10 and FIGS. 10–21 refer to a second embodiment of a child's bouncer seat 100.

First Embodiment

In the first embodiment of the invention, seat 10 includes a lower frame 12 including left and right ground engaging lower frame portions 30, 50 coupled to an upper seat frame 14 which includes a back supporting frame 16 and a lower seat frame 18. The seating area associated with seat frame 14 is provided by soft goods 24 suspended from back supporting frame 16 and lower seat frame 18. Seat 10 can also include a toy bar 26 and child harness 27. Lower frame portions 30, 50 are connected to each other by a frame connector 66 releasably coupling left and right rear frame segments. As will be discussed in greater detail below, the left and right connectors associated with frame connector 66 can be integrally formed with the left and right frame portions 30, 50 and configured to take advantage of the in-use loading and pre-loading of lower frame 12 for purposes of maintaining a secure connection between frame portions 30, 50. Although a child's bouncer seat is a presently preferred embodiment, the invention is by no means limited to a child's bouncer seat. As will become apparent, the various advantages of the frame connector of the invention exemplified by the following detailed description of the preferred embodiments, alternative embodiments, and as set forth in the accompanying claims, will sufficiently inform the skilled artisan of the wide range of uses for the frame connector without departing from the scope of invention.

Referring again to FIG. 2, left and right frame portions 30, 50 of lower frame 12 can be connected to back supporting frame 16 through a pair of left and right connectors 20, 22, respectively. Back supporting frame 16, lower frame 12 and lower seat frame 18 are preferably constructed from solid, elongated metal bar stock with a circular cross-section that are bent or formed into a desired shape. Such material is commonly referred to as wire form material. Of course, material other than wire form may be used and, depending on the loading on seat 10, may be preferable over wire form. However, bent wire frame is preferred for seat 10 because it provides adequate strength and it is a low cost approach for manufacturing a seat frame. Each of connectors 20, 22 are preferably made from plastic and include an upper sleeve 21*a*, 23*a*, and lower sleeve 21*b*, 23*b* for receiving, respectively, the left and right terminal ends of back supporting frame 16 and ends 32, 52 of lower frame 12. Lower seat frame 18 is coupled to upper ends 32, 52 by forming loops in the left and right ends of lower seat frame 18 and inserting upper ends 32, 52 through the loops. The generally U-shaped configuration of back supporting frame 16 and lower seat frame 18 support soft goods 24 defining the seating area for a child placed in seat 10, as illustrated in FIG. 1.

Figure 2:
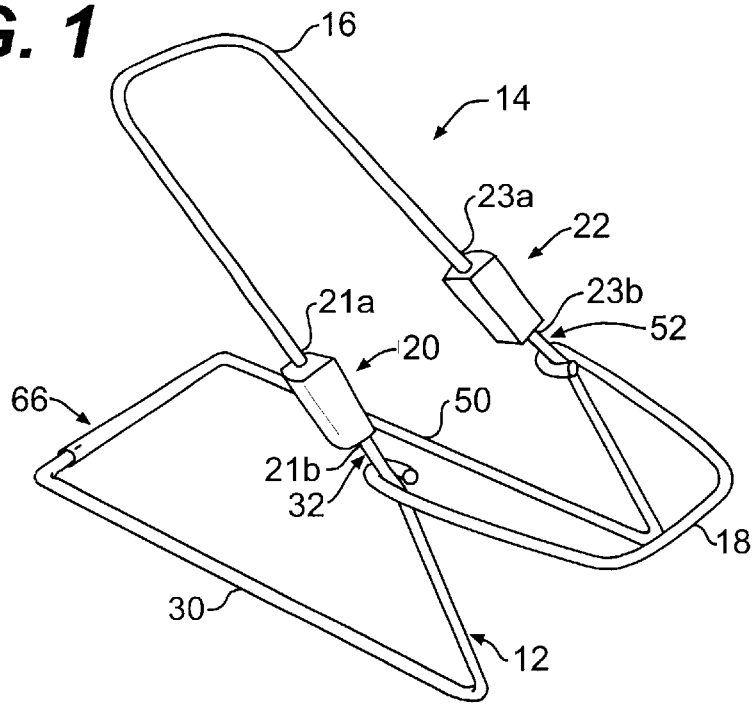
FIG. 2 is a perspective view of a frame of the child support of FIG. 1.
Figure 3:
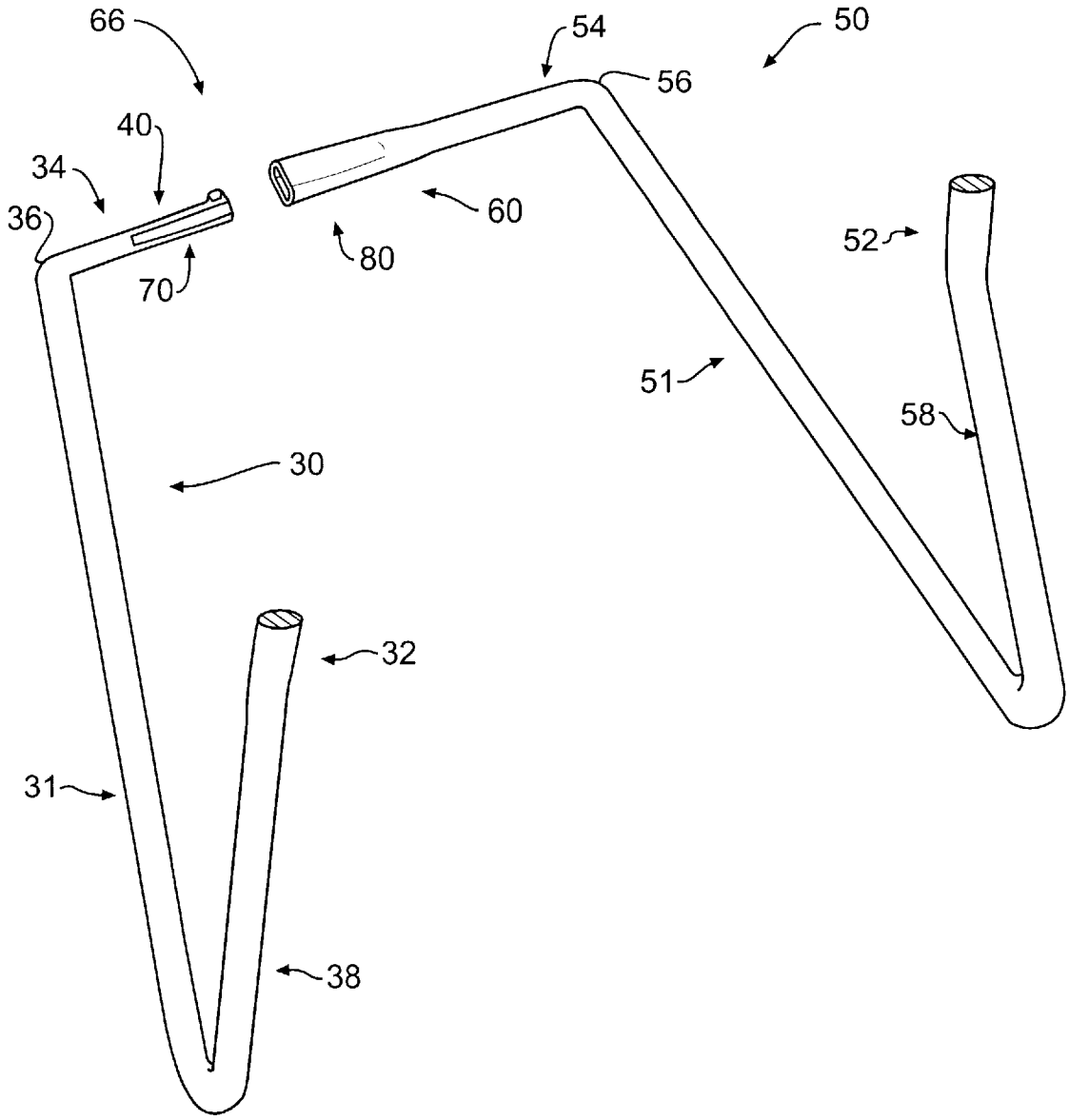
FIG. 3 is an exploded perspective view of a left and right frame portion of the frame of FIG. 1.

Referring to FIGS. 2 and 3, lower frame 12 may be of a two piece construction including of left frame portion 30 and right frame portion 50 coupled to seat frame 14 at upper ends 32, 52. Each of left frame portion 30 and right frame portion 50 respectively include upper ends 32, 52, rear ends 34, 54, straight portions 31, 51 extending forwardly and diverging outwardly from rear ends 34, 54 and U-shaped portion 38, 58 extending upwardly and terminating at upper ends 32, 52. Rear ends include bends 36, 56 forming left and right inwardly projecting segments 40, 60 which, when connected by frame connector 66, describe a transverse connection between frame portions 30, 50. Frame portions 30, 50 are preferably constructed with U-shaped portions 38, 58 to provide bouncing motion to seat 10 through the flexibility associated with U-shaped portions 38, 58. The portion of left and right frame portions 30, 50 rearward of the bend associated with U-shaped portions 38, 58 generally corresponds to the ground-engaging portion of lower frame 12. Lower frame 12 is preferably configured to provide a stable support for seat frame 14 by connecting left and right frame portions 30, 50 at rear ends 34, 54 through frame connector 66 and by configuring straight portions 31, 51 to extend forwardly and diverge outwardly so as to position the seating area associated with seat frame 14 generally between left and right frame portions 30, 50.

Frame connector 66 of the first embodiment will now be described in detail with reference to examples of frame connector 66 in FIGS. 3–8. Referring to FIGS. 3–6, frame connector 66 can include a left connector 70, formed at left segment 40, which is configured for engagement with a right connector 80 formed at right segment 60. Left and right connectors 70, 80 are preferably integrally formed with frame portions 30, 50 by a forming process (e.g., stamping) applied to segments 40, 60. Thus, in a preferred embodiment, connectors 70, 80 are preferably formed from the same segments of wire form stock used to form left and right frame portions 30, 50. Connectors 30, 50 may alternatively be formed from separate stock material and/or material, such as plastic, and then secured to the respective segments 40, 50. In still another embodiment, connectors 70, 80 may correspond to the connecting end portions of left and right segments that are selectively rotatably coupled to the rearward end portions of straight portions 31, 51. In such an embodiment, the left and right extending portions may be folded to facilitate a more compact folding of the support frame.

Figure 4:
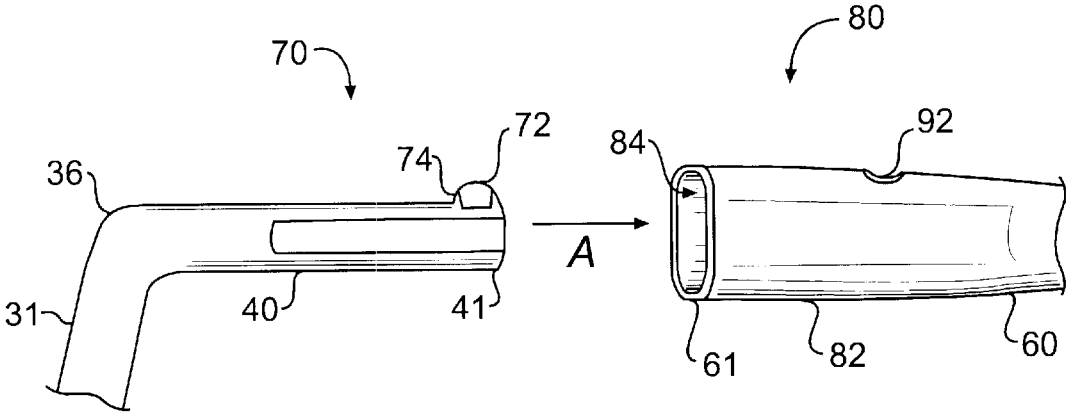
FIG. 4 is a side view of a left and right frame connector for connecting the left and right frame portions of FIG. 3.
Figure 5:
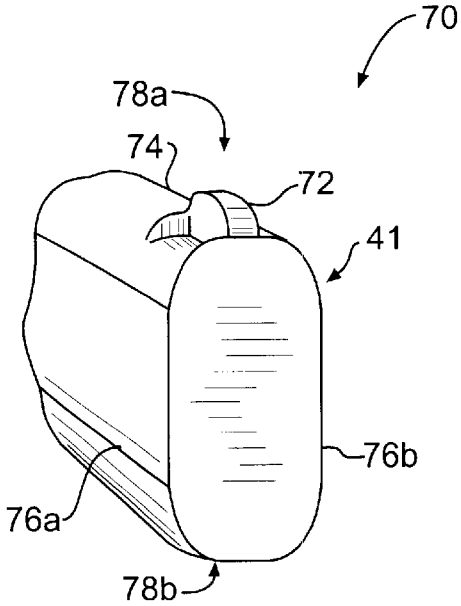
FIG. 5 is a perspective view of a portion of the left frame connector of FIG. 4.
Figure 6:
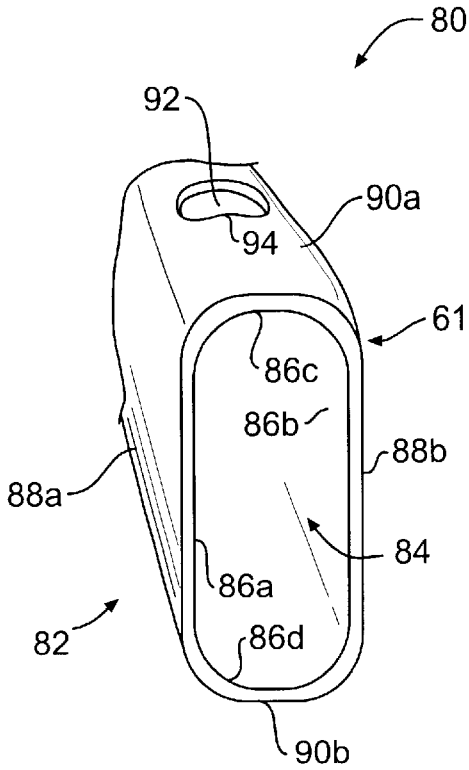
FIG. 6 is a perspective view of a portion of the right frame connector of FIG. 4.

Referring to FIGS. 4–6, left connector 70 describes a longitudinally extending portion of left segment 40 having an end corresponding to segment end 41. The cross-section associated with left connector 70 is preferably formed into a ellipsoidal-like cross section describing generally flattened left and right sides 76*a*, 76*b* extending between top and bottom ends 78*a*, 78*b*. Right connector 80 describes a longitudinally extending channel 82 of segment 60 with an entrance aperture 84 corresponding to segment end 61. Channel 82 has left and right inner walls and outer walls that are preferably formed so as to provide generally flat, opposed inner and outer wall surfaces 86*a*, 86*b*, 88*a*, 88*b* extending between top and bottom surfaces 86*c*, 86*d*, 90*a*, 90*b*. Left connector 70 includes an extension 72 extending upwardly from end 41. Extension 72 describes a mating surface 74 rearward of end 41 for engaging a locking surface 94 of channel 82 which preferably corresponds to a forward surface of a hole 92 bored through the top end of channel 82. Preferably, mating surface 74 and locking surface 94 describe the structure providing the mechanical connectivity of frame connector 66 which resists separation of left segment 40 from right segment 60. Thus, when left connector 70 is inserted into channel 82 and extension 72 protrudes through hole 92, any loading of left segment 40 or right segment 60 which tends to remove left connector 70 from channel 82 will be counteracted by the reaction force provided by the mating engagement between mating surface 74 and locking surface 94.

Figure 7:
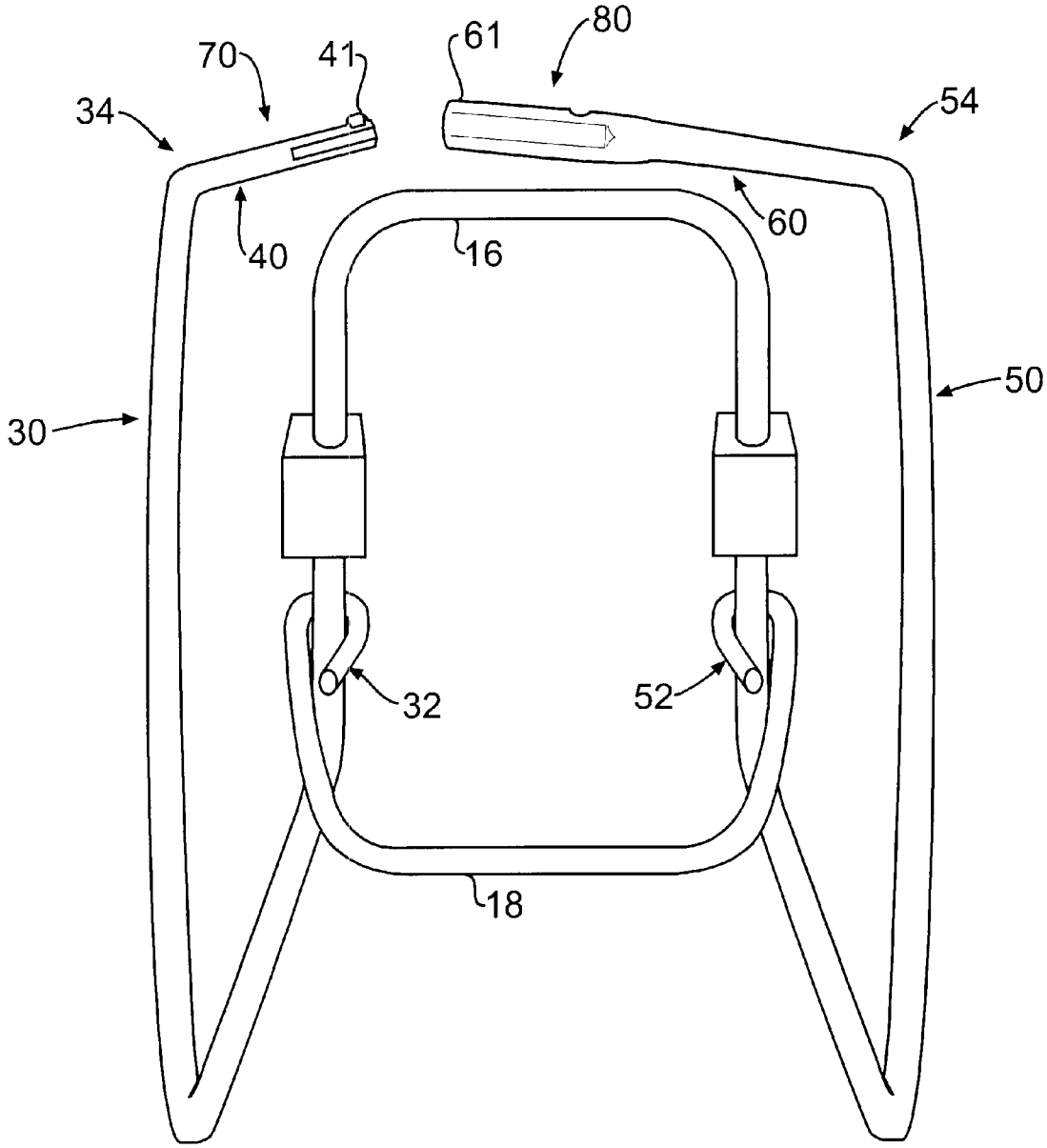
FIG. 7 is a top view of the left and right frame portion s of the seat frame of FIG. 2 with rear ends unconnected.

As will be discussed in greater detail, below, the relationship between the location of mating surface 74 and locking surface 94 and the in-use loading (i.e., the loading of frame 12 when a child is placed in the soft goods seating area) and/or pre-loading (the phrase "pre-loading" refers to the internal loads created in frame 12 when ends 32, 52 are inserted into sleeves 21*b*, 23*b* and rear ends 34, 54 are forcible flexed to allow left connector 70 to be inserted into channel 82 of right connector 80, as illustrated in FIG. 7) of lower frame 12 permits channel 82 to be "over-sized" without detracting from the effectiveness of frame connector 66. "Oversized" refers to the inner wall surfaces 86 of channel 82 defining a clearance that is greater than the cross-sectional dimensions of end 41 of left segment 40. As a result, end 41 is freely insertable within channel 82. That is, connector 70 may inserted without manipulation of connectors 70, 80 or elastically deforming either channel 82 or extension 72. An over-sized channel 82, however, is not required since channel 82 need only be formed with a clearance that is sufficient to allow left connector 70 to be insertable within channel 82 such that extension 72 is positionable adjacent or slightly beyond hole 92.

In an alternative embodiment, mating surface 74 may be formed on an inner wall 86 of channel 82 with a corresponding depression or hole formed on left connector 70. In still another embodiment, one or both of left connector 70 and right connector 80 may be encased or covered by a sleeve of plastic or other relatively compliant material for purposes of, e.g., enhancing retention forces between left and right connector 70, 80.

Left and right connectors 70, 80 provide a mechanical interlock securing left and right frame portions, as opposed to some existing frame connectors that rely on friction to securely connect portions of a frame (hereinafter a "friction connector"). For example, a common type of friction connector includes a male portion that is sized to be forcibly or snugly received within a female portion to secure first and second frame members together (a friction connector of this type is common in frame connectors that are used to connect elongate frame portions along their respective longitudinal axes). The frictional forces between the male and female portions are relied upon to hold the first and second frame members together. Thus, the first and second frame members are released by simply applying sufficient force to exceed the frictional retention forces. While this type of connection may provide an adequate restraint for the frame in some cases, the connection can also be unreliable since the frictional forces will, over time, become ineffective as the frame and/or connectors are subjected to repeated use or abuse by the user such as when the frame is frequently disassembled or transported. In contrast, the frame connector of the invention provides a positive mechanical interlock.

Frame connector 66 can be configured to take advantage of the in-use loading and pre-loading of lower frame 12 for purposes of maintaining a secure connection between frame portions 30, 50. As was mentioned above, "in-use loading" refers to the loads carried by lower frame 12 when, for example, a child is placed in seat 10, and "pre-loading" of frame 12 refers to the internal loads created in left and right frame portions 30, 50 when upper ends 32, 52 are coupled to connectors 20, 22 and left connector 70 is inserted through aperture 84 of right connector 80. In a preferred embodiment, left and right ends 34 and 54 of frame portions 30, 50 will naturally extend outwardly and away from each other, as illustrated in FIG. 7. Thus, in order to insert left connector 70 through aperture 84, either or both of rear end 34 and rear end 54 must be forcible flexed into alignment. As a result, when left connector 70 is inserted into channel 82, upper end 78*a* of left connector 70 will be biased towards upper wall 86*c* of channel 82 so as to cause extension 72 to protrude through hole 92. This condition is illustrated by the cross-sectional view of frame connector 66, FIG. 9, which shows a greatly exaggerated deformation of left and right segments 40, 60 for illustrative purposes.

Figure 8:
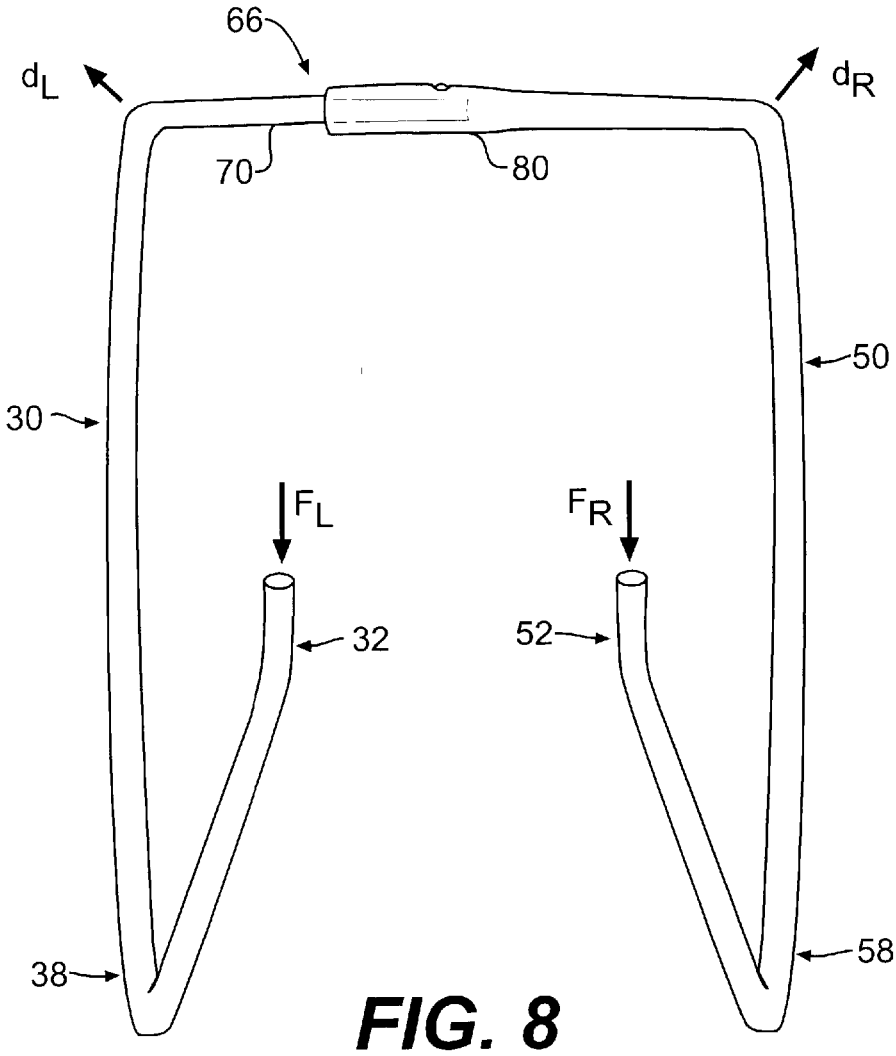
FIG. 8 is a top assembled view of the left and right frame portions of FIG. 3 illustrating forces acting on the left and right frame portions of FIG. 2 when a child is placed in the child support of FIG. 1.
Figure 9:
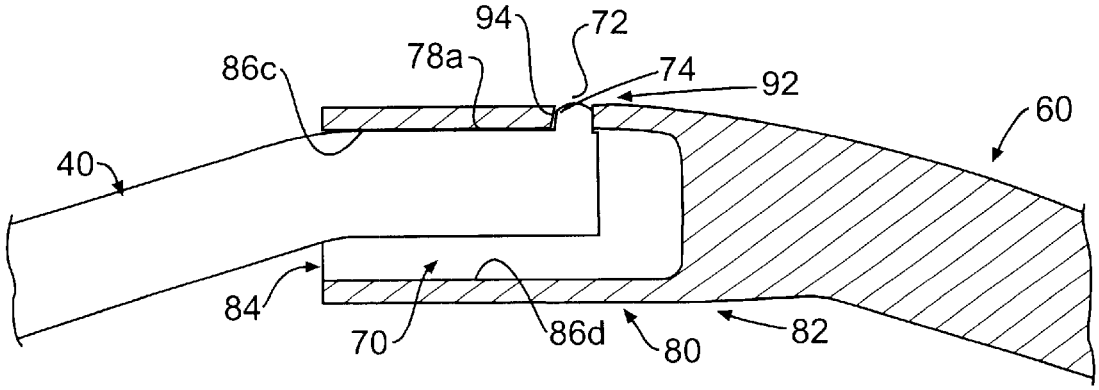
FIG. 9 is an exaggerated cross-sectional view of the connected rear ends of the frame portions of FIG. 2 in the vicinity of the frame connector.

FIG. 8 illustrates an exaggerated view of the deformed lower frame 12 when downwardly directed left and right forces $F_L$ and $F_R$ (generally associated with a child placed in the seat) are applied at respective left and right upper ends 32, 52. As mentioned above, seat frame 14 is positioned between frame portions 30, 50. With this configuration, forces $F_L$ and $F_R$ cause left and right frame portions 30, 50 to deflect outwardly in the directions $d_L$ and $d_R$. The tendency for frame portions 30, 50 to deflect outwardly will also result in upper end 78*a* of left connector 70 being biased towards upper wall 86*c* of channel 82 so as to cause extension 72 to protrude through hole 92, as illustrated in FIG. 9.

Second Embodiment

The second and presently preferred embodiment of a child's bouncer seat describes a similar seat and lower frame, but incorporates an alternative upper frame connector for connecting the lower frame portions to the back supporting frame and an alternative lower frame connector for connecting the lower frame portions to each other.

Figure 10:
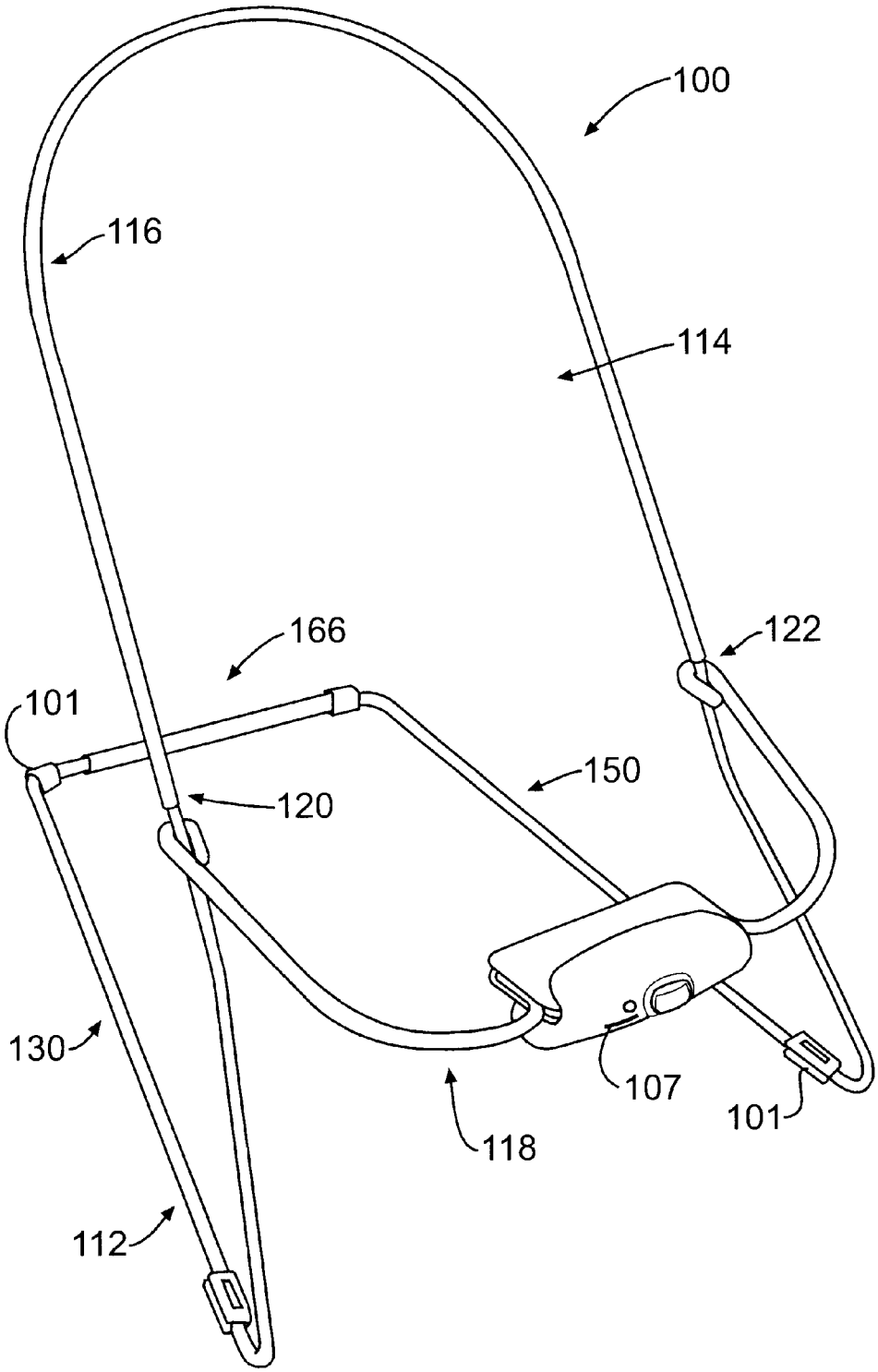
FIG. 10 is a perspective view of a second and preferred embodiment of a child support made in accordance with the principles of invention.

Referring to FIG. 10, seat 100 includes a lower frame 112 including left and right ground engaging lower frame portions 130, 150 coupled to an upper seat frame 114 which includes a back supporting frame 116 and a lower seat frame 118. The seating area associated with frames 116 and 118 may be provided by soft goods suspended from frames 116, 118, as in the case of seat 10, and a vibrator 107 may be coupled to lower frame 118. Back supporting frame 116 is connected to lower frame portions 130, 150 by upper frame connectors 120, 122. Lower frame portions 130, 150 are connected to each other at their rearward ends by frame connector 166. As will be described in greater detail, below, frame connector 166 includes a separate base bar 165 having ends configured for engagement with the rearward ends of frame portions 130, 150 in a manner similar to that of connector 66.

Figure 11:
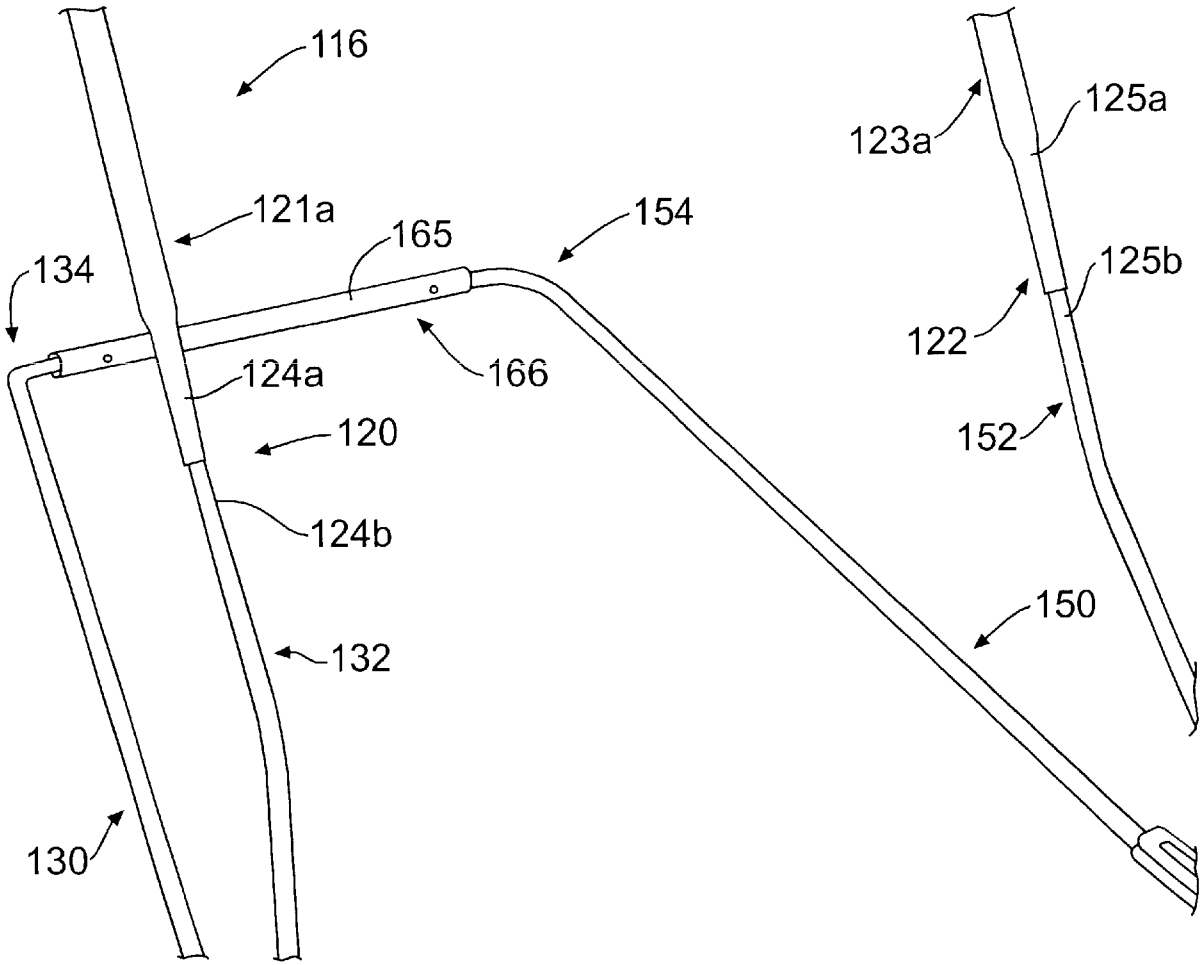
FIG. 11 is a partial perspective view of the child support of FIG. 10 with a lower seat frame removed.
Figure 12:
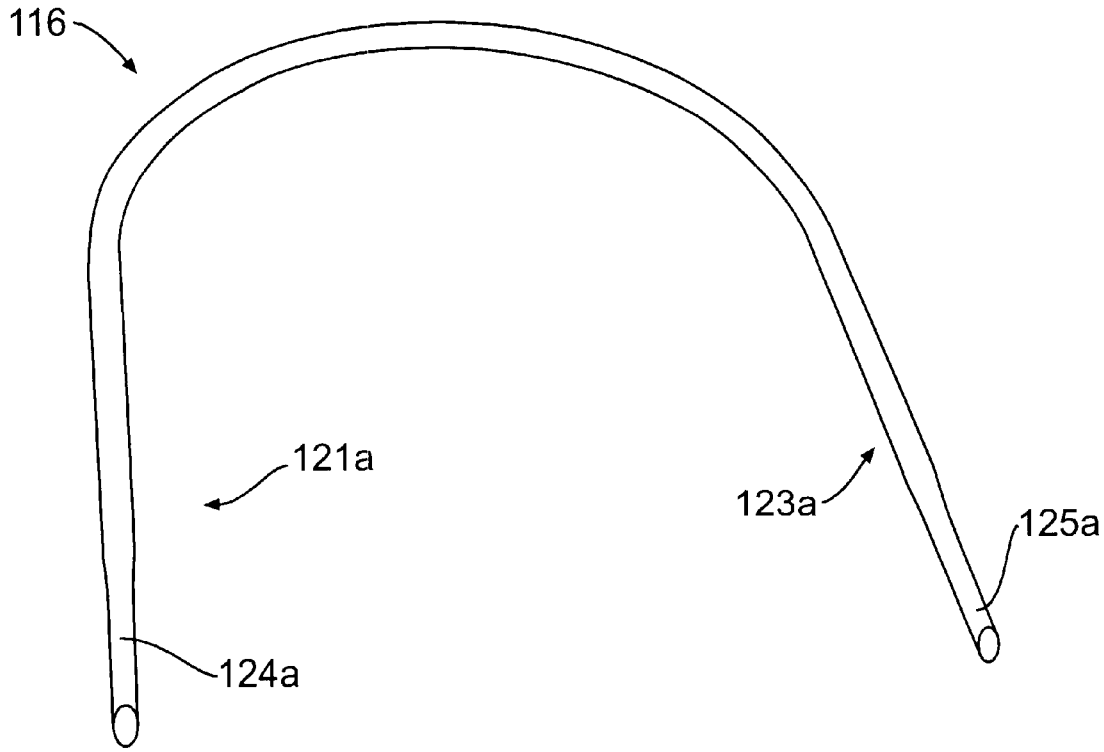
FIG. 12 is a perspective view of a back supporting frame of the child support of FIG. 10.
Figure 13:
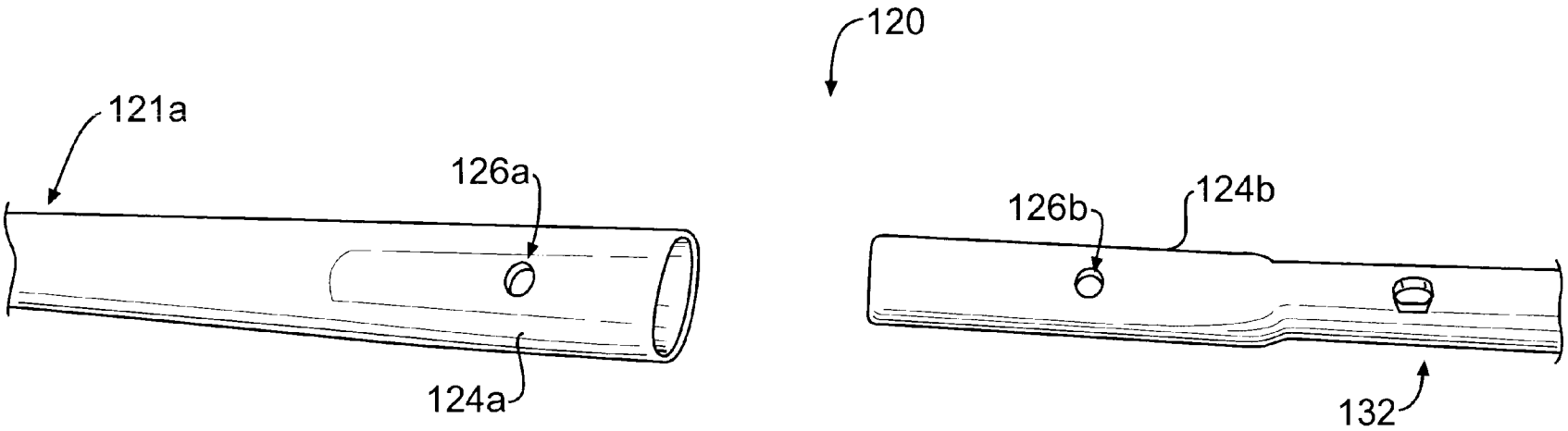
FIG. 13 is a perspective view of a frame connector assembly for connecting the back supporting frame to the lower frame portion of the child support of FIG. 10.

Referring to FIGS. 11–13, back supporting frame 116 is preferably U-shaped and constructed from a circular, hollow tube with identical ends 121*a*, 123*a* formed with flattened ends. These elliptical-like channels describe left and right female connectors 124*a*, 125*a*. Lower frame portions 130, 150 are preferably formed from solid, wire form material, as in the first embodiment. However, in the second embodiment, upper ends 132, 152 preferably include flattened terminal ends which describe male connectors 124*b*, 125*b* that are receivable in female connectors 124*a*, 125*a* for connecting lower frame portions 130, 150 to back supporting frame 116 directly. It is preferred to connect flattened ends of back supporting frame 116 with respective flattened ends of lower frame portions 130, 150 since this will provide an increased bending inertia in the plane where the predominately single-plane bending moment is carried by this frame connection during use. Thus, ends 121*a*, 123*a* and 132, 152 are flattened so as to provide increased bending inertia in the plane that extends approximately perpendicular to the seating surface of seat 100. The flattened ends also provide increased strength in the area of the through hole 126 (discussed below) which receives a shear pin or bolt. Frame connectors 170, 180 (discussed below) associated with frame connector 166 also describe essentially flattened ends which also will tend to increase the bending inertia in the plane where much of the bending occurs in the vicinity of frame connector 166. A perspective view of the left frame connector 120 of the preferred embodiment is illustrated in FIG. 13. The male/female portions of connectors 120, 122 may be shaped by a forming process, e.g., stamping. Connectors 124, 125 preferably include holes 126*a*, 126*b* bored through female connector 124*a* and male connector 124*b*, respectively. When connector 124*b* is inserted into connector 124*a*, holes 126*a*, 126*b* will be aligned to thereby define a through hole for receiving a shear pin, bolt or similar fastener. The left and right pair of through holes may also function as receiving holes for the left and right ends of a wire frame support for a toy bar, e.g., toy bar 26 of the first embodiment.

Figure 14:
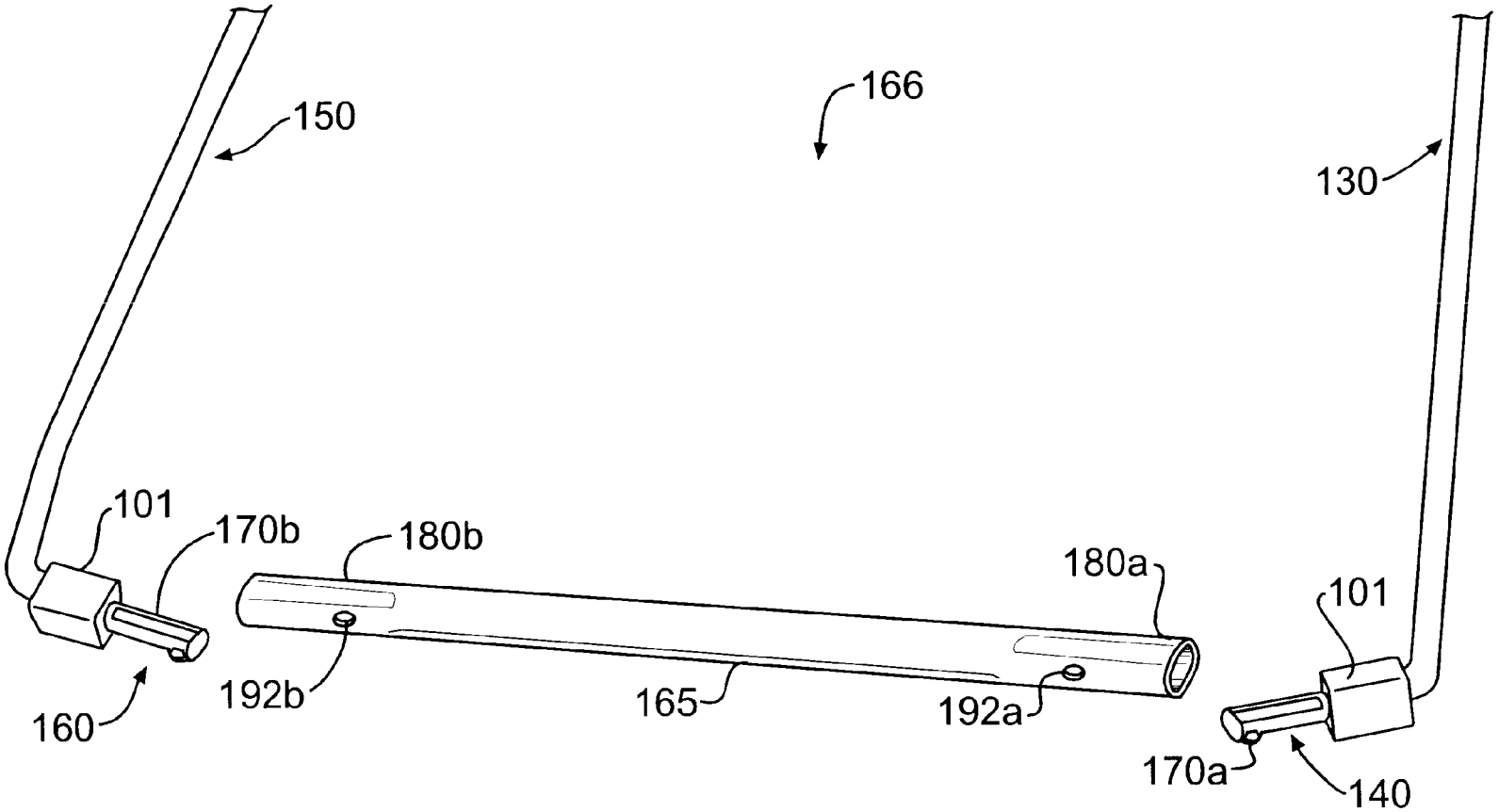
FIG. 14 is an exploded view of a frame connector assembly for connecting lower frame portions of the child support of FIG. 10
Figure 15:
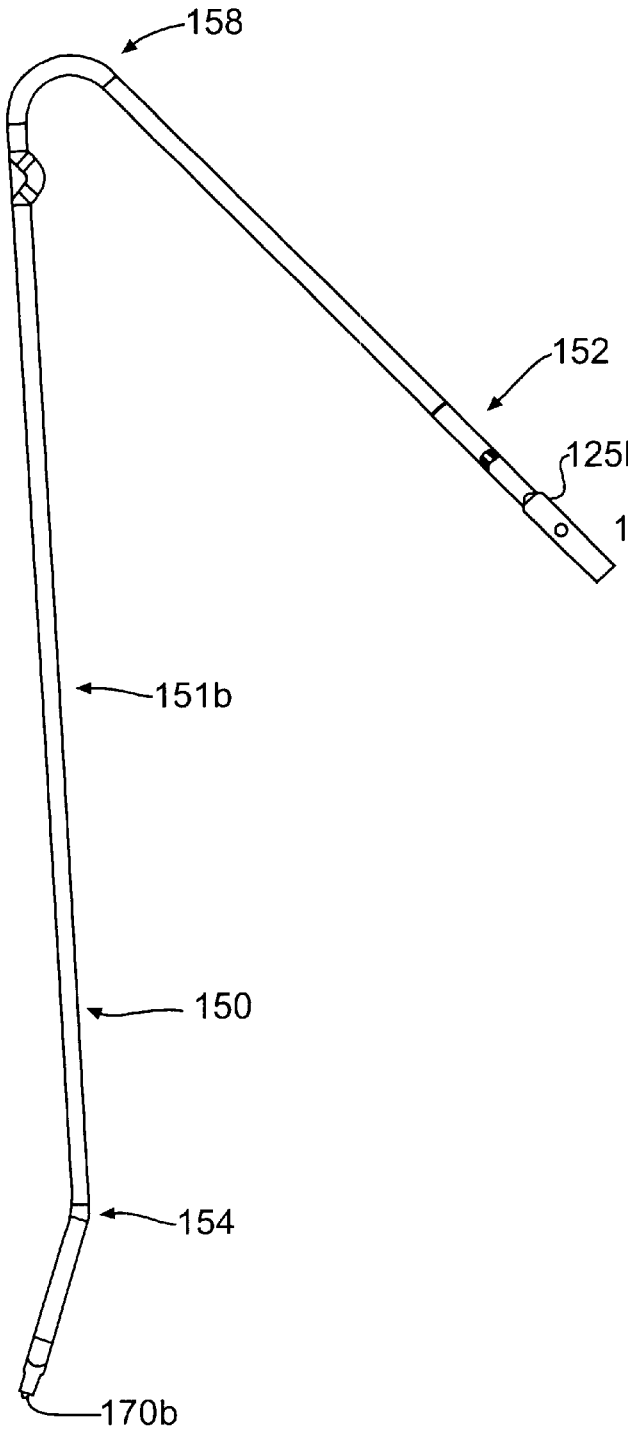
FIG. 15 is a side view of a lower frame portion of the child support of FIG. 10.
Figure 16:
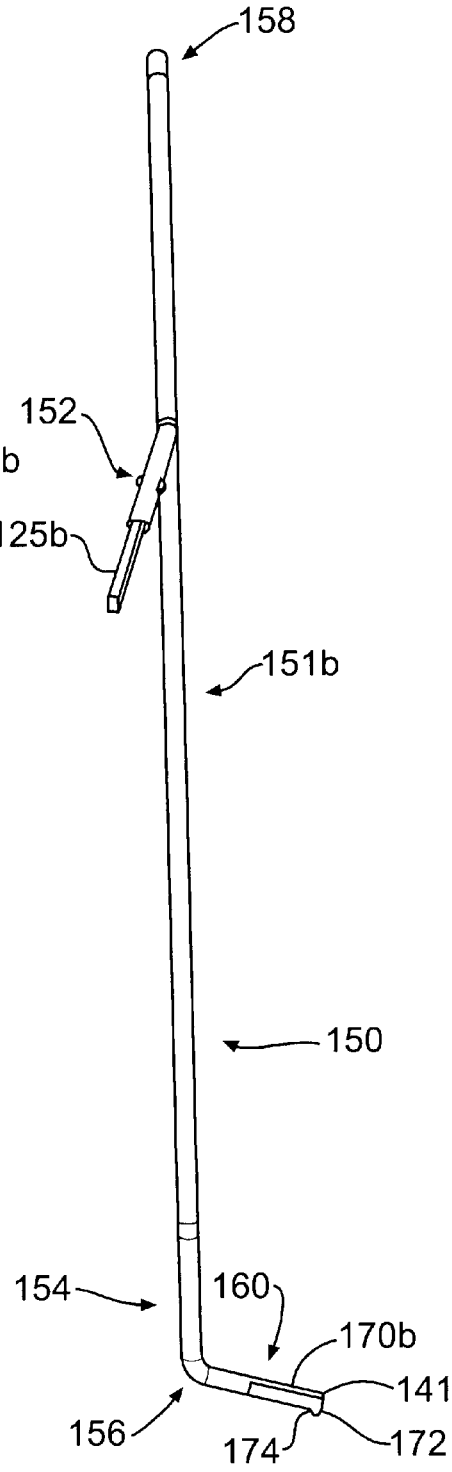
FIG. 16 is a top view of the lower frame portion of FIG. 15.
Figure 17:
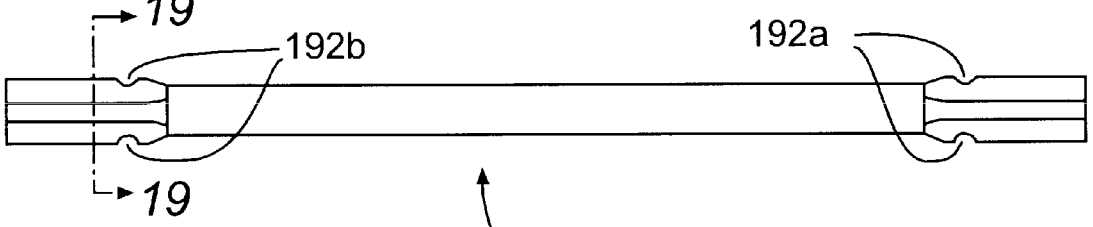
FIG. 17 is a first view of a base bar of the frame connector assembly of FIG. 14.
Figure 18:
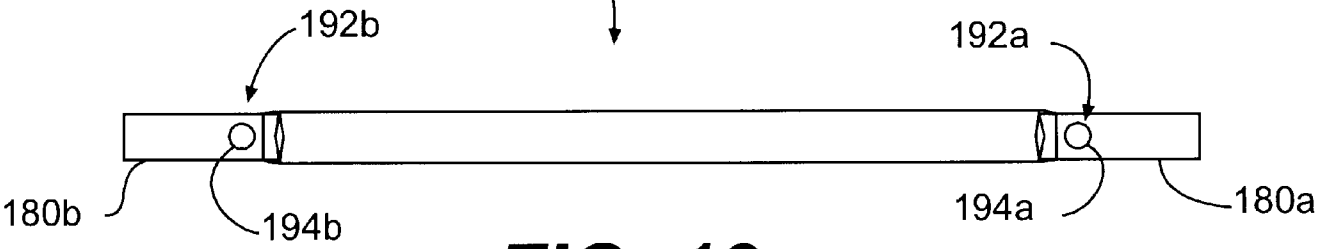
FIG. 18 is a second view of the base bar of FIG. 17.
Figure 19:
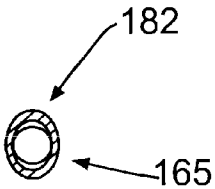
FIG. 19 is a third view of the base bar portion of FIG. 17 taken along lines 19—19 in FIG. 17.
Figure 20:
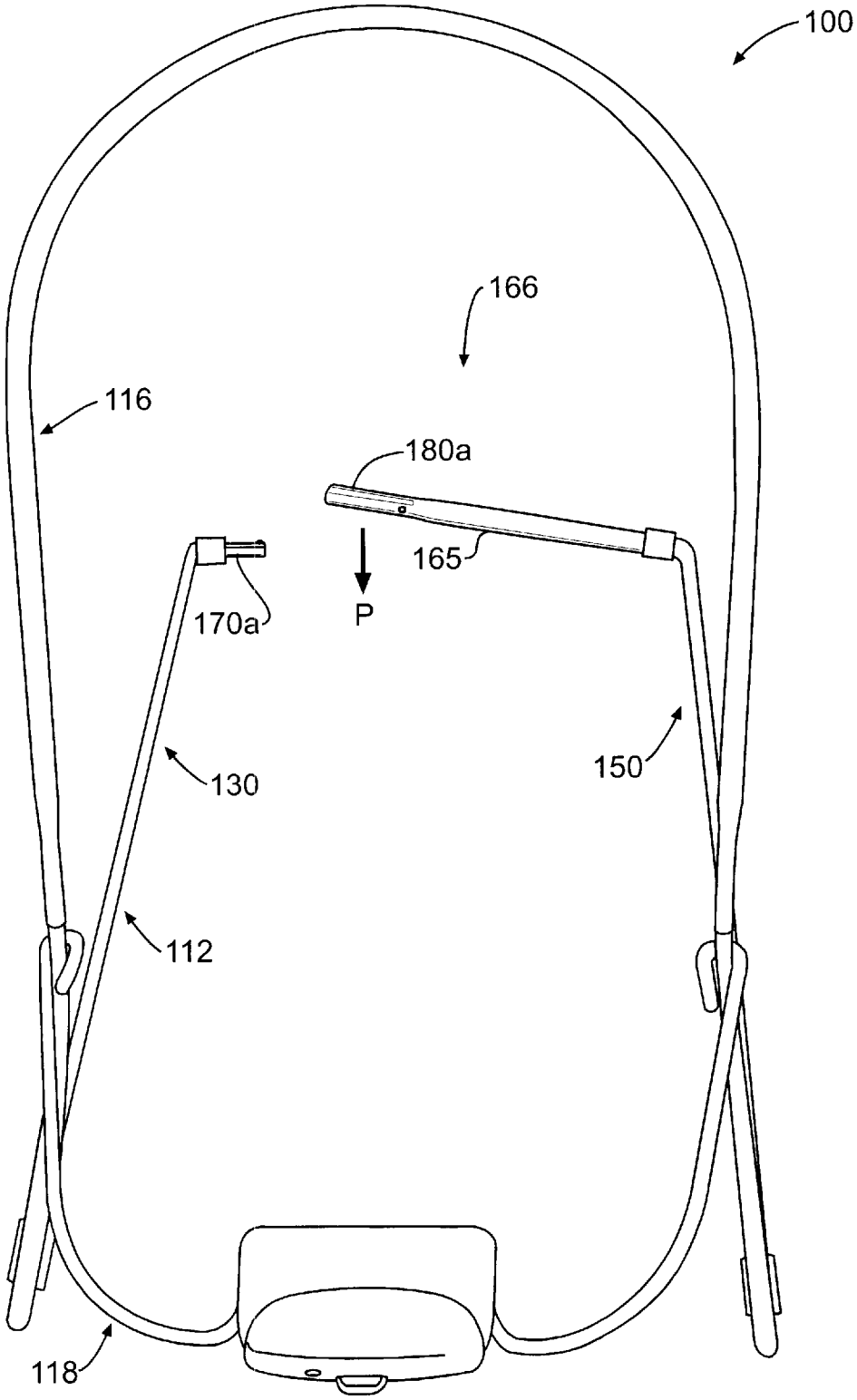
FIG. 20 is a partial assembled view of the child support of FIG. 10.

Referring to FIGS. 10, 11 and 14–16, lower frame portions 130, 150 are configured in a similar manner as frame portions 30, 50 of the first embodiment and seat frame 114 in a similar manner to seat frame 14 of the first embodiment (each of frames 130, 150 also include a pair of rubber-like pads 101 for engaging a supporting surface for seat 100, as shown in FIGS. 10 and 14). In the second embodiment, however, upper ends 132, 152 preferably include identically formed connectors 124*b*, 125*b* (as discussed above) and rear ends 134, 154 preferably include identically configured, inwardly extending segments 140, 160. Frame portions 130, 150 of the second embodiment are therefore mirror images of each other. Because of this similarity between frame portions 130, 150, reference will be limited to right frame portion 150 with the understanding that the same description applies to left frame portion 130. Right frame portion 150 includes a straight portion 151*b* and a U-shaped portion 158 extending upwardly and terminating at upper end 152. Rear end 154 of right frame portion 150 includes a bend 156 forming segment 160 with a connector 170*b* formed at a terminal end thereof. Connector 170*b* is preferably configured in the same manner as connector 70 of the first embodiment. Thus, connector 170*b* describes an ellipsoidal-like extension with a protrusion 172 and mating surface 174 formed at a terminal end 141 of segment 160. Connector 170*b* need not be formed as an ellipsoidal-like connector, but may alternatively take on a shape which resembles a square, rectangular or circular type cross-section (e.g., the cross-section of the common variety wire form stock). Left frame portion 130 includes an identically shaped connector 170*a* formed at a terminal end of segment 140, FIG. 14.

Frame connector 166 of the second embodiment will now be described with reference to FIGS. 14 and 17–19. Frame connector 166 includes a base bar 165 preferably formed from a hollow, metal tube stock having left and right mating connectors 180*a*, 180*b* integrally formed at the respective left and right terminal ends of base bar 165. Connectors 180*a*, 180*b* are configured to receive connectors 170*a* and 170*b* of left and right frame portions 130, 150. Connectors 180*a*, 180*b* of base bar 165 are similar in structure and function to connector 80 of the first embodiment. Thus, each of connectors 180*a*, 180*b* describe an oversized channel 182 adapted to receive connectors 170*a*, 170*b*. Each of connectors 170*a*, 170*b* include a hole 192*a*, 192*b* defining locking surfaces 194*a*, 194*b* which engage with the corresponding mating surfaces 174 of the protrusions 172 formed on each of connectors 170*a*, 170*b*. As mentioned above, the cross-sections associated with connectors 170*a*, 170*b* are preferably ellipsoidal-like, but may alternatively take on other cross-sections (e.g., circular). However, it is preferred to have a non-circular cross-section for connectors 170*a*, 170*b* and mating connectors 180*a*, 180*b* since this will encourage the user to properly align base bar 165 relative to connectors 170*a*, 170*b*. When base bar 165 is properly aligned and connectors 170 and 180 are engaged with each other, protrusions 172 will be positioned to extend through holes 192 when frame connector 166 is loaded.

Frame connector 166 exploits the in-use and/or preloading of seat 100 in a similar manner as frame connector 66 of the first embodiment. For example, referring to a partial assembled view of seat 100 with left and right frame portions 130, 150 unconnected, FIG. 20, in order to engage connectors 170*a* and 180*a*, base bar 165 must first be forcibly flexed into alignment with left frame portion 130, i.e., connector 180*a* must be pulled into alignment with connector 170*a*, as indicated by external force P in FIG. 20. Once connected, the loads carried in base-bar 165 and frame portions 130, 150 are such that the protrusions formed on connectors 170*a*, 170*b* are biased into engagement with the respective locking surfaces 194*a*, 194*b* of base bar 165. Hence, by positioning locking surfaces on the walls of base bar 165 opposing the outward flexing of frames 130, 150, a self locking connector is achieved. It is also seen that the nature of the loading on lower frame 112 when seat 100 is subject to normal in-use loading will tend to urge protrusions into engagement with locking surfaces 194*a*, 194*b* since the upper frames 118, 116 associated with seat 100 are generally positioned within frame portions 130, 150 (as discussed earlier), thereby tending to push frame portions 130, 150 outwardly and away from each other when seat 100 is in use.

As is now apparent, other connectable support frames may utilize one or more of the above advantages of the frame connector of the invention and in particular, may utilize a connectable support frame that includes a frame connector that exploits an in-use and/or pre-load condition of a preferred frame design by identifying the load distribution in the frame, and by configuring and locating the frame connector at an appropriate location on the frame. It is therefore understood that the frame connector of the invention is not limited to the preferred configuration of lower frames 12 or 112 since one of ordinary skill in the art is capable of identifying the regions of a support frame where a frame connector constructed in accordance with the invention may be located.

What is claimed is:

1. A child support device, comprising:

a frame including a ground-engaging portion, child-supporting portion and first and second elongate legs each having an end, said first and second legs each defining a longitudinally extending first and second leg axis, respectively;

a first connecting portion extending parallel to the first leg axis and terminating at the first leg end, said connecting portion including a fixed, outwardly extending protrusion extending approximately perpendicular to the first leg axis; and a first retaining portion including a slot extending parallel to the second leg axis and a locking surface for engaging said protrusion, said first retaining portion terminating at the second leg end and said first retaining portion being adapted for receiving the first connecting portion;

wherein said first and second legs are coupled together by the mating of said first connecting portion with said first retaining portion.

2. The child support device of claim 1, wherein said retaining portion is integrally formed with said second leg and said connecting portion is integrally formed with said first leg.

3. The child support device of claim 1, wherein said slot includes a forward entrance aperture for receiving said connecting portion, said entrance aperture being described by a closed-walled chamber wherein said locking surface is distal from said entrance aperture.

4. The child support device of claim 1, wherein a cross-sectional dimension of said connecting portion includes the cross-section of said protrusion and said slot defines a clearance that is the distance between opposed inner wall surfaces of said slot and wherein said clearance is greater than the cross-sectional dimension, thereby permitting said connecting portion and protrusion to move freely within said slot.

5. The child support device of claim 4, wherein said connecting portion and retaining portion are formed from a rigid material.

6. The child support device of claim 4, wherein said connecting portion cross-section describes a generally ellipsoidal-like cross section and said slot describes a generally ellipsoidal-like channel for receiving said connecting portion.

7. The child support device of claim 1, wherein when said connecting portion is inserted into said retaining portion and a child is placed in said support device, so as to cause said frame to become loaded by the externally applied forces originating from the child's weight, said protrusion is urged into mating engagement with said locking surface.

8. The child support device of claim 1, wherein said slot includes an entrance aperture for receiving said connecting portion and wherein said entrance aperture is described by opposed walls that are devoid of openings and slots.

9. The child support device of claim 1, wherein said fixed protrusion corresponds to a post integrally formed with said extension.

10. The child support device of claim 1, further including:

a second connecting portion extending parallel to the second leg axis and terminating at the second leg end, said second connecting portion including a fixed, outwardly extending protrusion extending approximately perpendicular to the second leg axis; and an elongate member having first and second ends, wherein said first retaining portion is located on said first end and a second retaining portion, identical to said first retaining portion, is located on said second end;

wherein said first and second legs are coupled together by insertion of said first connecting portion into said first retaining portion and insertion of said second connecting portion into said second retaining portion.

11. A child support, comprising:

first and second leg portions extending from respective first and second rear ends and terminating at respective first and second support ends;

a support for receiving a child thereon, said support being connected to each of said first and second support ends; and a coupler for releasably connecting said first and second leg portions wherein when said first and second legs are connected to each other, at least one of said first and second legs are predisposed to flex outwardly and away from the other, said coupler including:

a first portion disposed on said first leg, an oversized slot disposed on said second leg and being adapted for receiving said first portion, said slot defining a clearance that is slightly greater than the cross-sectional dimensions of said first portion so as to allow said first portion to move freely within said slot, and means for retaining said first portion within said slot, said means for retaining including a protrusion disposed on one of said first portion and said slot for engaging a locking surface disposed on the other of said first portion and said slot, wherein the at least one of said first and second legs tend to flex outwardly and away from the other causes one of the protrusion and the locking surface to be urged into mating engagement with the other of the protrusion and the locking surface.

12. The child support of claim 11, said first portion including a first surface and said slot including a second surface, wherein said first surface bears against said second surface by the at least one of said first and second legs being predisposed to flex outwardly when said first and second legs are connected to each other, wherein said means for retaining said first portion within said slot when a child is placed in the seat further includes one of said protrusion and said locking surface being disposed on said first surface and the other of said protrusion and said locking surface being disposed on said second surface.

13. The child support of claim 11, wherein each of said first and second leg portions further includes an intermediate portion extending forwardly and diverging outwardly from the respective first and second rear ends.

14. The child support of claim 13, wherein said child's seat is a bouncer seat.

15. The child support of claim 13, wherein each of said first and second intermediate portions have a forward end corresponding to a generally U-shaped rod and wherein said support is disposed rearwardly from said U-shaped rod.

16. A method for providing a connectable support frame for a child support, the connectable support frame being formed from a single type of material, said method comprising the steps of:

forming a first elongate frame portion with a first terminal end and outwardly projecting knob integrally formed therewith, wherein the knob is formed so as to project upwardly from the terminal end;

forming a second elongate frame portion with a second terminal end describing a longitudinally extending first slot and locking surface integrally formed therewith, the first slot including an opening describing a height that is slightly greater than the combined heights of the left terminal end and knob, thereby allowing left terminal end to be freely received within the first slot; and connecting the first frame portion to the second frame portion by aligning the first terminal end with the first slot and inserting the first terminal end and knob into the first slot.

17. The method of claim 16, further including the steps of:

coupling the left and right frame portions to an upper support structure, wherein the resulting coupled frame portions and upper support structure cause at least one of the left and right frame portions to become predisposed to bias away from the other, and wherein said step of aligning the left terminal end with the slot includes the step of manually flexing the left frame portion to bring the left terminal end into alignment with the slot.

18. The method of claim 16, wherein the left and right frame portions are made from a relatively rigid material.

19. The method of claim 16, wherein each of the left and right elongate frame portions have a longitudinally extending first outer surface describing a first cross section that is elliptical and the first and second terminal ends have an outer surface, wherein each of said steps of forming a left and right elongate frame portion further includes the step of forming the outer surface of the terminal end so as to create opposed flattened wall portions.

20. The method of claim 16, wherein the first elongate frame portion is formed from solid bar stock and the second elongate frame portion is formed from hollow bar stock.

21. A connectable support frame, said connectable support frame being suitable for use as a child support device, said connectable support frame comprising:

a frame including a first elongate leg having an end and defining a first leg axis, and a second elongate leg having an end and defining a second leg axis, wherein said frame is unconnected when said first and second leg ends are de-coupled from each other and wherein when said frame is unconnected said first and second leg ends are biased away from each other;

a connecting portion extending parallel to the first leg axis and being disposed on the first leg end, said connecting portion including an outwardly extending protrusion extending approximately perpendicular to the first leg axis; and a retaining portion disposed on the second leg end, said retaining portion including a slot extending parallel to the second leg axis for receiving the connecting portion wherein when said connecting portion is received in said slot said leg axes are orientated approximately parallel to each other;

wherein when said connecting portion is received within said retaining portion, said first and second legs are coupled together and at least one of said first and second legs includes a pre-load as a result of being coupled to the other, and wherein said locking member and protrusion are urged into a mating engagement by the pre-load which tends to bias said first and second legs away from the other.

22. The support frame of claim 21, wherein said retaining portion is a hollow tube having first and second ends and wherein said slot corresponds to the first end of said tube and wherein said second leg is releasably received on said tube second end.

23. The support frame of claim 22, wherein said first and second legs are solid bars.

24. The support frame of claim 21, wherein each of said first and second legs further include a third and fourth elongate leg, respectively, said third and fourth elongate legs defining third and fourth leg axes, wherein said third and fourth leg axes are approximately perpendicular to said first and second leg axes and define a substantial portion of the ground-engaging portion of said frame.

25. The support frame of claim 24, wherein said first and second legs correspond to bends formed in said third and fourth legs.

* * * * *